United States Patent [19]

Rudolph

[11] 4,174,068

[45] Nov. 13, 1979

[54] GUN HAVING DISPOSABLE CARTRIDGE

[76] Inventor: Robert L. Rudolph, c/o Cartri-Spray Corporation, 310 Peoples Ave., Rockford, Ill. 61101

[21] Appl. No.: 958,428

[22] Filed: Nov. 7, 1978

[51] Int. Cl.[2] ..... B05B 9/047

[52] U.S. Cl. ..... 239/322; 239/416.5; 239/423; 222/630; 222/327; 222/389

[58] Field of Search ..... 222/323, 324, 326–327, 222/334, 193, 183, 389; 239/322, 416.5, 416.2, 423

[56] References Cited

U.S. PATENT DOCUMENTS

| | | | |
|---|---|---|---|
| 1,435,790 | 11/1922 | Bachman | 222/386.5 X |
| 2,296,047 | 9/1942 | Morgan et al. | 222/327 |
| 2,797,772 | 7/1957 | Beckmann | 222/389 X |
| 2,959,358 | 11/1960 | Vork | 222/334 X |
| 3,001,576 | 9/1961 | Biber et al. | 239/423 X |
| 3,087,682 | 4/1963 | Peeps | 239/424 X |
| 3,724,601 | 4/1973 | Scragg | 222/389 X |

FOREIGN PATENT DOCUMENTS

| | | | |
|---|---|---|---|
| 479322 | 3/1953 | Italy | 239/322 |
| 492504 | 3/1954 | Italy | 239/322 |

*Primary Examiner*—Joseph J. Rolla
*Assistant Examiner*—Charles A. Marmor
*Attorney, Agent, or Firm*—Leydig, Voit, Osann, Mayer & Holt, Ltd.

[57] ABSTRACT

A disposable cartridge containing flowable material is positioned removably in the barrel of a spray gun, the cartridge having a spout telescoped into the nozzle of the gun. When pressurized air is admitted into the gun, part of the air flows into the barrel to force the material out of the cartridge and the spout and into the nozzle. The remainder of the pressurized air passes into the nozzle to atomize the material and to cause the material to spray out of the nozzle as a fine mist.

5 Claims, 3 Drawing Figures

GUN HAVING DISPOSABLE CARTRIDGE

CROSS-REFERENCE TO A RELATED APPLICATION

This application is a substitute for my abandoned application Ser. No. 729,170, filed Oct. 4, 1976.

BACKGROUND OF THE INVENTION

This invention is concerned with a spray gun. Apparatus having a relation to the present invention is disclosed in Wilkinson U.S. Pat. No. 1,578,944; Froidevaux U.S. Pat. No. 2,708,600; Beckmann U.S. Pat. No. 2,797,772 and Italian Pat. No. 479,322.

SUMMARY OF THE INVENTION

The general aim of the present invention is to provide a gun which utilizes a disposable cartridge containing flowable material and which, at the same time, is adapted to spray the material outwardly in the form of a mist.

A more detailed object is to provide a spray gun having a barrel with a nozzle and having a disposable cartridge with a spout, the cartridge being adapted to fit in the barrel and the spout being adapted to fit in the nozzle. When pressurized air is admitted into the gun, part of the air forces flowable material out of the cartridge through the spout while the rest of the air acts within the nozzle to cause the material to spray out of the nozzle as a fine mist.

The invention also resides in the novel construction of the nozzle, in the unique relationship between the nozzle and the spout and in the novel formation of the barrel with interlocking hooks and fingers.

These and other objects and advantages of the invention will become more apparent from the following detailed description when taken in conjunction with the accompanying drawings.

DETAILED DESCRIPTION OF THE PREFERRED EMBODIMENT

Figures 1, 2, 3:
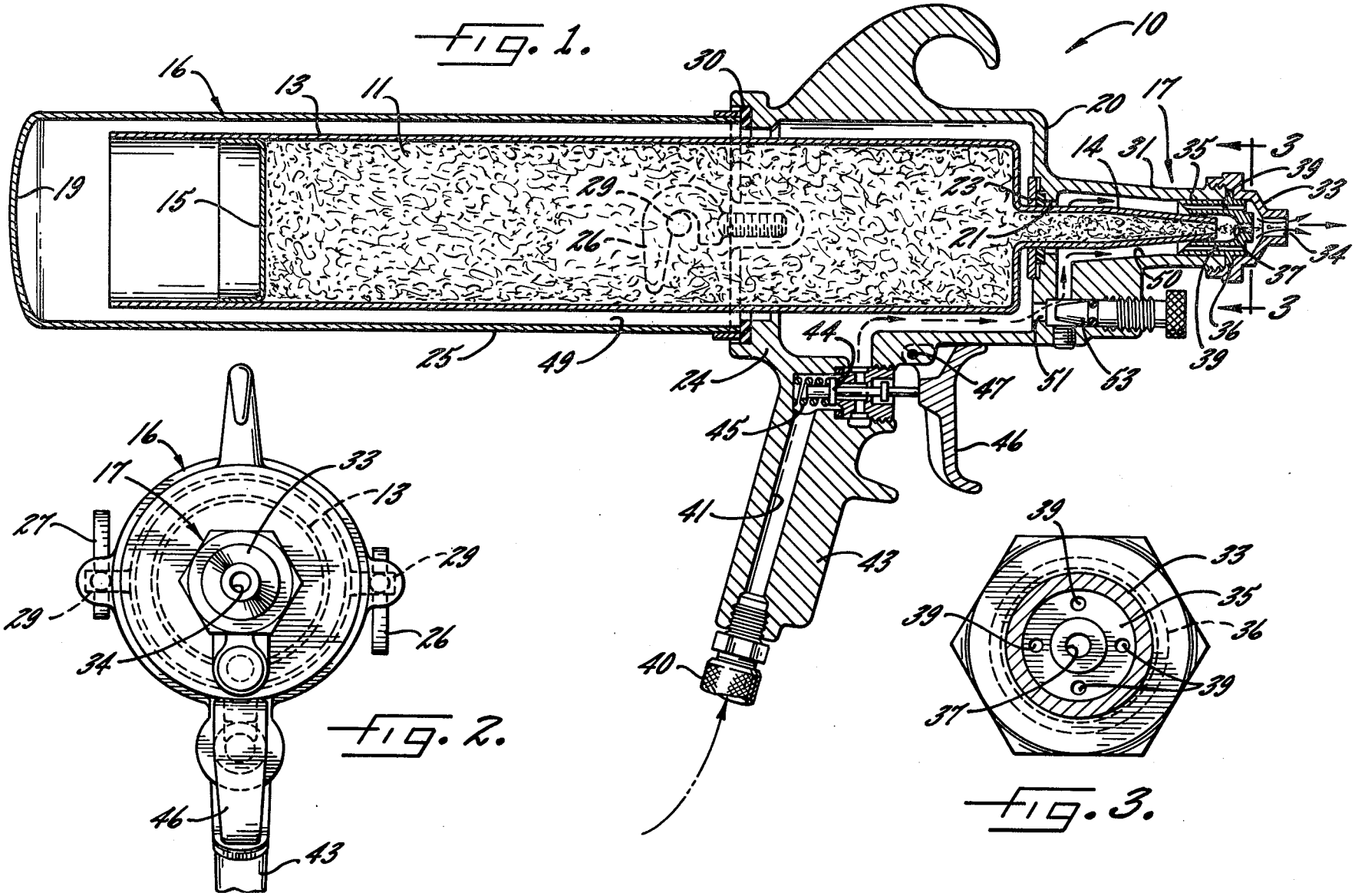
FIG. 1 is a cross-sectional view taken longitudinally through a new and improved spray gun incorporating the unique features of the present invention.
FIG. 2 is an end view of the gun as seen from the right in FIG. 1.
FIG. 3 is an enlarged cross-section taken substantially along the line 3—3 of FIG. 1.

As shown in the drawings for purposes of illustration, the invention is embodied in a portable gun 10 for spraying flowable material 11. While the gun could be used for spraying various liquid, semi-liquid or even powdered materials, it herein is specifically adapted to spray liquid plastic having a consistency somewhat similar to that of whipped cream.

The present invention contemplates the provision of a unique gun 10 which is capable of dispensing the liquid plastic 11 from an inexpensive and disposable cartridge 13, the plastic being atomized into a fine mist as an incident to being dispensed. By virtue of the cartridge, the gun remains comparatively clean and may be quickly and easily adapted for use with a cartridge containing a different material. Also, the cartridge facilitates filling of the gun and enables unused material to be saved for use at a later time.

More specifically, the cartridge 13 is similar to the well known cartridges which contain caulking compound and the like. Thus, the cartridge is of elongated tubular shape and is made from a cylinder of paperboard or other suitable material. A forwardly tapered dispensing spout 14 is joined to and projects from the closed forward end of the cartridge and communicates with the interior of the cartridge. Telescoped slidably into the rear portion of the cartridge is a disc or piston 15 which, when advanced forwardly, forces the material out of the cartridge and the spout.

In keeping with the invention, the gun 10 includes a barrel 16 for receiving the cartridge 13 and a nozzle 17 for receiving the spout 14. The barrel also is of elongated tubular shape and is formed with a closed rear end 19 and with an opposite forward end 20 having a centrally located opening 21 therethrough. The cartridge 13 is located in the barrel 16 with the spout 14 projecting through the opening 21 and into the nozzle 17. An elastomeric ring 23 surrounds the rear side of the opening 21 and seals around the spout 14 to restrict the escape of air through the opening.

To enable the cartridge 13 to be inserted into and removed from the barrel 16, the latter is formed with a forward portion 24 and with a separate rear portion 25, the forward and rear portions being detachably connected in end-to-end relationship. For this purpose, a downwardly opening hook 26 is screwed into the rear end of the forward portion 24 of the barrel on one side thereof while an upwardly opening hook 27 (FIG. 2) is screwed into the rear end of the forward portion in diameterically spaced relation with the hook 26. The two hooks are adapted to interlock with diametrically spaced fingers 29 on opposite sides of the rear portion 25 of the barrel. By rotating the forward portion 24 counterclockwise (FIG. 2), the hooks may be released from the fingers to enable endwise separation of the forward and rear portions. When the hooks are subsequently re-interlocked with the fingers, they draw the rear portion 25 into snug engagement with a sealing gasket 30 (FIG. 1) encircling the rear end of the forward portion 24.

The nozzle 17 includes a main body 31 whose forward end is threadably connected to a detachable tip 33 having a central discharge hole 34. A removable spray head 35 (FIGS. 1 and 3) is telescoped into the body 31 and tip 33 and is telescoped over the spout 14, the head having a flange 36 which is clamped between the body and the tip to hold the head in place. As shown in FIGS. 1 and 3, the head 35 is formed with a central hole 37 alined with the spout 14 and the hole 34 and further is formed with a series of holes 39 spaced angularly around and located outwardly of the hole 37.

In carrying out the invention, pressurized air is admitted into the gun 10 with part of the air being used to advance the piston 15 and force the plastic 11 out of the spout 14 and with the remaining air passing through the holes 39 in the head 35 and serving to atomize the plastic as it passes through the holes 37 and 34. In this instance, the pressurized air is delivered to the gun by means of a flexible hose 40 which communicates with a passage 41 formed in a pistol grip handle 43 integral with the forward portion 24 of the barrel 16. A valve 44 is located in the passage 41 and is biased to a closed postion by a coil spring 45. By squeezing a trigger 46 pivotally attached to the barrel 16 at 47, the valve 44 may be opened to admit pressurized air into the barrel.

As shown in FIG. 1, the cartridge 13 is spaced inwardly from the barrel 16 and thus an air passage 49 is defined between the cartridge and the barrel. In addition, the spout 14 is spaced inwardly from the nozzle 17 so that a second air passage 50 is defined between the spout and the nozzle. The passage 50 communicates with the passage 49 by means of a hole 51 in the forward end 20 of the barrel, there being an adjustable needle valve 53 located adjacent the hole 51 for regulating the flow of air into the passage 50.

With the foregoing arrangement, actuation of the trigger 46 results in pressurized air being admitted into the passage 49 with such air acting against the piston 15 to advance the latter forwardly. Thus, the piston forces the plastic 13 out of the cartridge 11 and the spout 14 and through the hole 37 in the head 35. As the plastic emerges from the hole 37, it encounters jets of air flowing through the holes 39 by way of the hole 51 and the passage 50. The air jets atomize the plastic and thus the plastic is sprayed out of the tip 33 as a fine mist having a high velocity.

From the foregoing, it will be apparent that the present invention brings to the art a new and improved gun 10 which makes advantageous use of a disposable cartridge 13 and which is adapted to break the plastic 11 up into the form of a spray. The gun is of relatively simple construction and may be filled, used and cleaned in a very simple manner.

I claim:

1. A gun for spraying flowable material, said gun comprising an elongated tubular barrel having a rear section with a closed rear end and having a separate forward section with an opening extending through its forward end, a forwardly opening tubular nozzle projecting forwardly from the forward end of said barrel and alined substantially with said opening, a disposable tubular cartridge containing said material and positioned removably in said barrel, means securing said rear and forward sections of said barrel together in end-to-end relation and being selectively releasable for the purpose of enabling said cartridge to be inserted into and removed from said barrel, said cartridge being spaced inwardly from said barrel to define a first passage between the cartridge and the barrel, a forwardly opening spout joined to and communicating with the forward end of said cartridge and telescoped through said opening and into said nozzle, said spout being spaced inwardly from said nozzle to define a second passage between the spout and the nozzle, a piston telescoped slidably into and closing the rear portion of said cartridge and being disposable as a unit with the cartridge, said piston being operable, when advanced forwardly, to force said material out of said spout, selectively operable means for admitting air into said first and second passages with the air admitted into said first passage being effective to advance said piston, and means disposed adjacent the forward ends of said nozzle and said spout and coacting with the air admitted into said second passage to cause the material which is forced from said spout to spray out of said nozzle, said last-mentioned means comprising a head telescoped into said nozzle and over said spout and having a centrally located hole extending therethrough to allow material to pass out of said spout and through said head, and a series of holes extending through said head and spaced angularly around said centrally located hole, said series of holes communicating with said second passage to allow pressurized air in said second passage to flow through said head.

2. A gun as defined in claim 1 in which said nozzle comprises a main body and a forward tip, said tip having a hole extending therethrough and alined with the centrally located hole in said head, and said tip being detachably connected to said body to enable said head to be inserted into and removed from said nozzle.

3. A gun as defined in claim 1 in which a pistol grip handle is attached to said barrel, said pressurized air being admitted into said passages through said handle, said selectively operable means comprising a valve mounted within said handle and adapted to be opened and closed to control the flow of said air, and a spring-loaded trigger located adjacent said handle and operable to effect opening and closing of said valve.

4. A gun as defined in claim 1 further including an adjustable needle valve located in said second passage for controlling the flow of air therethrough.

5. A gun as defined in claim 1 in which said securing means comprise a pair of fingers projecting outwardly in opposite directions from one section of said barrel, a pair of hooks connected rigidly to the other section of said barrel and hooked around said fingers, said hooks being hooked in opposite directions to enable said hooks to be released from said fingers by turning one of said barrel sections relative to the other section.

* * * * *